US006419344B2

(12) United States Patent
Fujii et al.

(10) Patent No.: US 6,419,344 B2
(45) Date of Patent: Jul. 16, 2002

(54) INK-JET HEAD AND INK-JET PRINTER

(75) Inventors: Masahiro Fujii; Hiroyuki Ishikawa, both of Shiojiri; Yasushi Matsuno, Matsumoto, all of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/808,165

(22) Filed: Mar. 13, 2001

(30) Foreign Application Priority Data

Mar. 13, 2000 (JP) ..... 2000-069409
Sep. 18, 2000 (JP) ..... 2000-282371

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS 5,900,894 A 5/1999 Koizumi et al.
5,963,234 A 10/1999 Miyazawa et al.

FOREIGN PATENT DOCUMENTS

EP 1 043 159 10/2000
JP 9-314836 12/1997
JP 9-327921 12/1997
JP 11-077989 3/1999
JP 11-129463 5/1999
JP 11-138826 5/1999
JP 2000-52545 2/2000
WO WO98/51506 11/1998
WO WO99/34979 7/1999

*Primary Examiner*—Raquel Yvette Gordon
(74) *Attorney, Agent, or Firm*—Rosalio Haro

(57) ABSTRACT

An ink-jet head includes a plurality of ink ejection nozzles, a plurality of ink pressure chambers provided corresponding to the respective ink ejection nozzles and respectively communicated with the corresponding ink ejection nozzles, a common ink chamber for supplying an ink to the respective of the ink pressure chambers, a plurality of ink supply orifices provided corresponding to the respective ink pressure chambers and communicating the respective ink pressure chambers and the common ink chamber, and electrostatic actuators for varying volume of respective of the ink pressure chambers by an electrostatic force for ejection of ink droplets from the corresponding ink ejection nozzles. A plurality of the ink pressure chambers is arranged in a plane and the common ink chamber stacked on the plurality of ink pressure chambers for reducing the length.

24 Claims, 10 Drawing Sheets

INK-JET HEAD AND INK-JET PRINTER

BACKGROUND OF THE INVENTION

1. Field of the Invention

The present invention relates to an electrostatic drive type ink-jet head. More particularly, the invention relates to an ink-jet head which is compact, requires reduced number of parts and easy to produce. Further particularly, the invention relates to an ink-jet printer mounting the ink-jet head.

2. Description of Related Art

As is well known, the electrostatic drive type ink-jet head is constructed to vary a volume of an ink pressure chamber communicated with an ink ejection nozzle by an electrostatic force and to eject a predetermined shape of ink droplet from the ink ejection nozzle utilizing a pressure variation generated in the ink pressure chamber. This type of the ink-jet head has been disclosed, for example, in U.S. Pat. No. 5,513,431 issued on May 7, 1996 and assigned to the same assignee of the present application.

Generally known electrostatic drive type ink-jet head has a plurality of ink pressure chambers respectively communicated with a plurality of ink ejection nozzles arranged in alignment. For avoiding influence of pressure variation in each ink pressure chamber to other ink pressure chamber, each ink pressure chamber is connected to a common ink chamber having large capacity, via an ink supply orifice. The common ink chamber is formed with an ink supply port. To the common ink chamber, an ink is supplied from an ink source through the ink supply port.

As disclosed in the above-identified U.S. Patent, at backside position of the ink ejection nozzles arranged in alignment, the ink pressure chambers are arranged in plane direction. On the backside position of these ink pressure chambers, ink supply orifices extending toward backside of the ink-jet head are formed. On backside position of these ink supply orifices, the common ink chamber is arranged on the same plane direction. The ink supplied to the common ink chamber through the ink supply port flows toward front side of the ink-jet head on the plane direction and is supplied to each ink pressure chamber through the ink supply orifice from the front end portion of the common ink chamber.

On the other hand, the electrostatic drive type ink-jet head of the construction set forth above is typically constructed with a semiconductor substrate. For example, by providing anisotropic wet etching for the surface of the monocrystalline silicon substrate, a groove for the common ink chamber and grooves for the ink pressure chambers are formed. Normally, by providing anisotropic wet etching from the surface of the monocrystalline silicon substrate having crystal orientation face of (100), a predetermined depth of rectangular groove in plane shape is formed, for example, for the common ink chamber.

Here, in the conventional electrostatic drive type ink-jet head, the ink pressure chambers, ink supply orifices and the common ink chamber are arranged on the common plane along a longitudinal direction of the ink-jet head. Accordingly, the ink-jet head is elongated in the longitudinal direction.

Therefore, for example, as disclosed in U.S. Pat. No. 5,963,234 issued on Oct. 5, 1999 and assigned to the same assignee of the present application, it is considered to arrange the ink pressure chambers at a height position different from the plane where the ink pressure chambers are arranged. The ink-jet head disclosed in the above-identified publication is a piezoelectric drive type. The construction as it is, is not applicable for the electrostatic drive type ink-jet head. Also, in the ink-jet head disclosed in the above-identified U.S. Patent, the common ink chamber, the ink pressure chambers and the ink supply orifices are defined by stacking a plurality of substrates. Although such a construction permits shortening of length in the longitudinal direction, a dimension in the thickness direction is significantly increased. Also, the number of components becomes large and that of fabrication steps also becomes large.

On the other hand, in the conventional electrostatic drive type ink-jet head formed with the common ink chamber having a rectangular shape in plane view, the inner side wall of the common ink chamber where the ink supply orifices are communicated to the chamber, extends in a width direction of the ink-jet head, and thus extends substantially perpendicular to the ink supply orifices extending in the longitudinal direction of the ink-jet head. Accordingly, on the inner side surface of the common ink chamber, particularly on both corner portions thereof, ink stagnation can be formed. Therefore, bubble penetrating within the common ink chamber as mixed with the ink can be accumulated in the corner portions. Once bubble is accumulated in the corner portions of the common ink chamber, it becomes difficult to stably supply the ink to the ink pressure chambers via the ink supply orifices located in the vicinity of the corner portions.

If sufficient ink supply is not performed to the ink pressure chambers located at both ends, ejection of the ink droplet in an appropriate condition cannot be performed through the ink ejection nozzles communicated with such ink pressure chambers. If such failure is caused, degradation of printing quality can be caused due to fluctuation of the ink ejection characteristics of the respective ink ejection nozzles.

SUMMARY OF THE INVENTION

An object of the present invention is to provide an electrostatic drive type ink-jet head which can shorten a length in the longitudinal direction thereof.

Another object of the present invention is to provide an electrostatic drive type ink-jet head which has a smaller number of components, is easy to product and short in the longitudinal direction.

A further object of the present invention is to provide a short electrostatic drive type ink-jet head, which can prevent accumulation of bubble in the common ink chamber resulting in fluctuation of ink ejection characteristics among the ink ejection nozzles, and which can prevent lowering of ink ejection characteristics of the ink ejection nozzle on both end sides.

A still further object of the present invention is to provide an ink-jet printer having the novel ink-jet head.

In order to accomplish the above and other objects, an ink-jet head comprises:

- a plurality of ink ejection nozzles;
- a plurality of ink pressure chambers provided corresponding to the respective ink ejection nozzles and respectively communicated with the corresponding ink ejection nozzles;
- a common ink chamber for supplying an ink to the respective ink pressure chambers;
- a plurality of ink supply orifices provided corresponding to the respective ink pressure chambers and communicating the ink pressure chambers to the common ink chamber;
- electrostatic actuators for varying volume of the respective ink pressure chambers by an electrostatic force for ejection of ink droplets from the corresponding ink ejection nozzles, a plurality of the ink pressure chambers being arranged in a plane; and the common ink chamber being stacked on the plurality of ink pressure chambers.

The ink-jet head according to the present invention can reduced the length thereof for the reason that the common ink chamber is stacked on the ink pressure chambers.

In the typical example, the ink-jet head includes a first substrate, a second substrate stacked on an upper surface of the first substrate and a third substrate stacked on an upper surface of the second substrate, the third substrate being formed with the common ink chamber and the ink supply orifices;

the second substrate being formed with the ink pressure chambers communicated with the ink ejection nozzles; and the electrostatic actuators being disposed between the first substrate and the second substrate.

In the three-layered structure, the nozzle grooves for forming the ink ejection nozzles are formed on a lower surface of the third substrate opposing the second substrate, on an upper surface of the second substrate, grooves for forming the ink pressure chambers are formed.

Instead of forming the nozzle grooves for forming the ink ejection nozzles in the third substrate, the ink-jet head may further comprise a fourth substrate formed with the ink ejection nozzles, wherein ink communication holes communicated with the ink pressure chambers are exposed on front end faces of the stacked second and third substrates, and the fourth substrate is fitted on the front end faces so that the respective ink nozzles are communicated with the corresponding ink communication holes.

The common ink chamber may be defined by a groove for forming the common ink chamber formed on the upper surface of the third substrate and a film sealing the groove, and at least one ink supply orifice is formed through bottom portion of the groove for forming the common ink chamber. In comparison with the case of forming the thin grooves on the surface of the substrate, forming through holes in the bottom portion of the common ink chamber for forming the ink supply orifices is easier. Also, a plurality of the ink supply orifices can be formed relatively easily. Furthermore, freedom in the designing the section and dimension of the orifice can be increased to facilitate adjustment of flow resistance of the ink supply orifice and thus to facilitate adjustment of the ink ejection characteristics of the ink-jet head. By forming greater number of ink supply orifices, if one of the orifices is blocked by a foreign matter contained in the ink, significant increase of ink flow resistance will be avoided, whereby maintaining a continuous ink supply to avoid harmful affect on the ink ejection amount, ink ejection speed and so forth.

In order to fabricate the third substrate having the nozzle grooves for forming the ink ejection nozzles, the ink supply orifices and the common ink chamber, the third substrate is a monocrystalline silicon substrate, the nozzle grooves for forming the ink ejection nozzles and the ink supply orifices are formed by trench etching by an ICP (inductively coupled plasma) discharge, and the groove for forming the common ink chamber is formed by anisotropic wet etching.

The film may be formed with the ink supply port, and a rib for supporting the film is provided in the common ink chamber for preventing the portion of the film where the ink supply port is formed, from deflecting in out-of-plane direction.

The ink-jet head may further comprise an ink supply port for introducing an ink into the common ink chamber, the ink supply orifices are communicated with a first end portion of the common ink chamber and the ink supply port is communicated with a second end portion of the common ink chamber, and a shape of the common ink chamber in plan view is tapered to be widen from the second end portion to the first end portion.

With this shape of the common ink chamber, the ink introduced into the common ink chamber through the ink supply ports can quickly flow toward the ink supply orifices in the common ink chamber without stagnation therein. Accordingly, accumulation of bubble in the common ink chamber due to stagnation of the ink therein can be successfully prevented or restricted. Particularly, stagnation of the ink at the corner portion of the common ink chamber at both end portions in the lateral or width direction can be prevented or restricted.

In the typical construction, the first end may be an end of the common ink chamber located at rear end side of the ink-jet head and the second end is an end of the common ink chamber located at front end side of the ink-jet head.

A bottom portion and inner peripheral side wall of the common ink chamber may be defined by a groove formed by anisotropic wet etching of a monocrystalline silicon substrate for a predetermined depth, and crystal orientation of the monocrystalline silicon substrate is (100), and the groove is defined by inner peripheral side walls having respective orientations parallel to (011) orientation face, 45° to the (011) operation face, and 90° to the (011) orientation face.

Particularly, it is desirable that the groove is defined by inner peripheral side walls having respective orientations parallel to (011) orientation face, 19° to the (011) operation face, 45° to the (011) operation face, and 90° to the (011) orientation face.

By performing an isotropic wet etching, the respective inner peripheral side walls of the common ink chamber can easily be formed to be flat surfaces, flow of the ink in the common ink chamber becomes smooth to contribute for restriction or elimination of stagnation of bubble therein.

The electrostatic actuator may include a vibration plate formed in a bottom portion of each of the ink pressure chamber, elastically displaceable in out-of-plane direction and serving as a common electrode, and an individual electrode formed on the upper surface of the first substrate and opposing to the vibration plate with a given clearance therebetween.

According to another aspect of the present invention, an ink-jet printer comprises:

an ink-jet head as set forth above;

a printing paper feeding mechanism for feeding a printing paper across a printing position where printing is performed by the ink-jet head; and drive control means for driving the ink-jet head for performing printing on the printing paper passing across the printing position.

The ink-jet head is a line ink-jet head with the ink ejection nozzles arranged over an entire printing width. In the alternative, the ink-jet printer may be one that comprises a carriage carrying the ink-jet head for reciprocal motion over a printing width.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENTS

The present invention will be discussed hereinafter in detail in terms of the preferred embodiment of an electrostatic drive type ink-jet head of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure are not shown in detail in order to avoid unnecessary obscurity of the present invention.

First Embodiment

Figure 1:
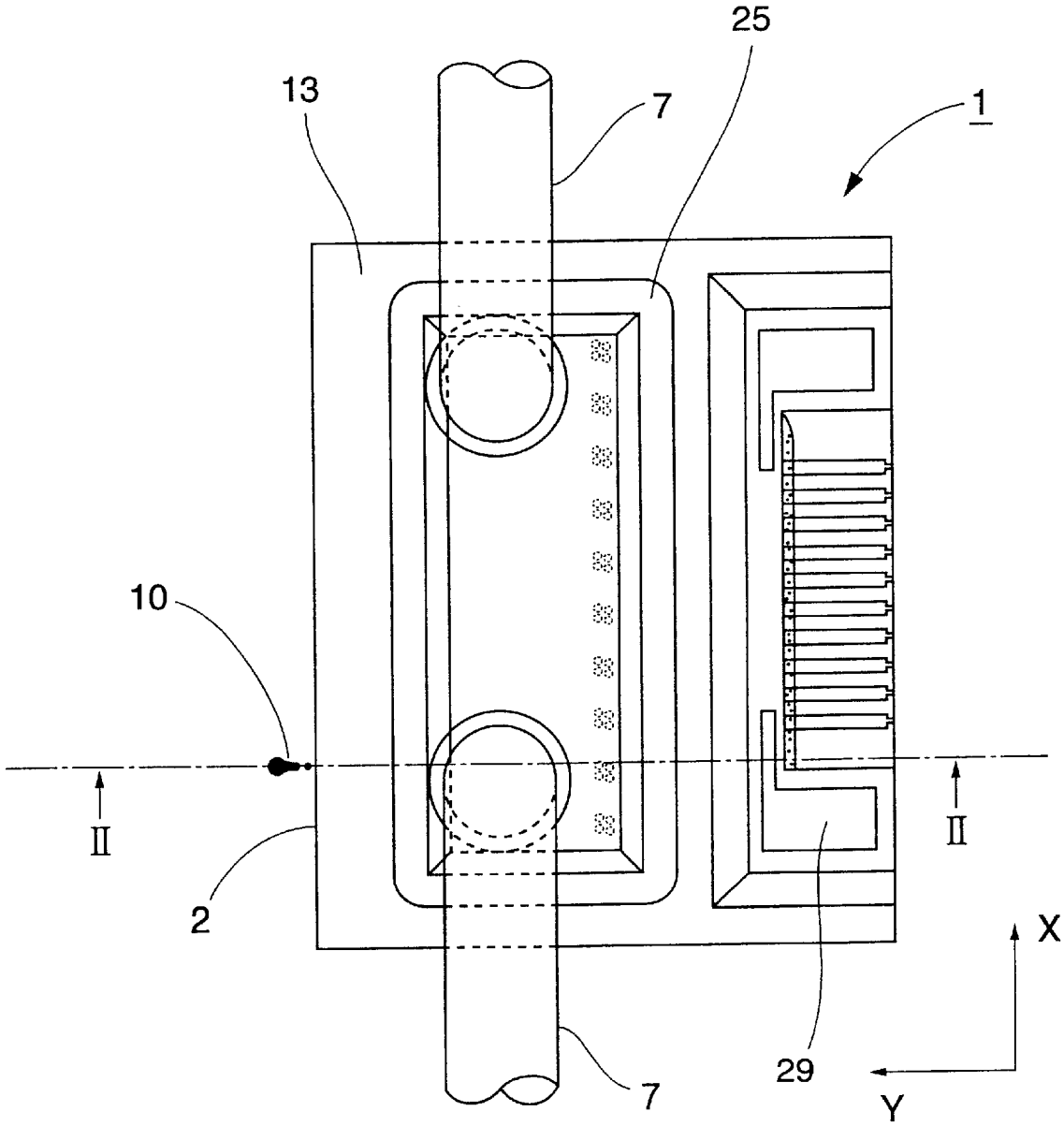
FIG. 1 is a general plan view showing an electrostatic drive type ink-jet head to which the present invention is applied.
Figure 2:
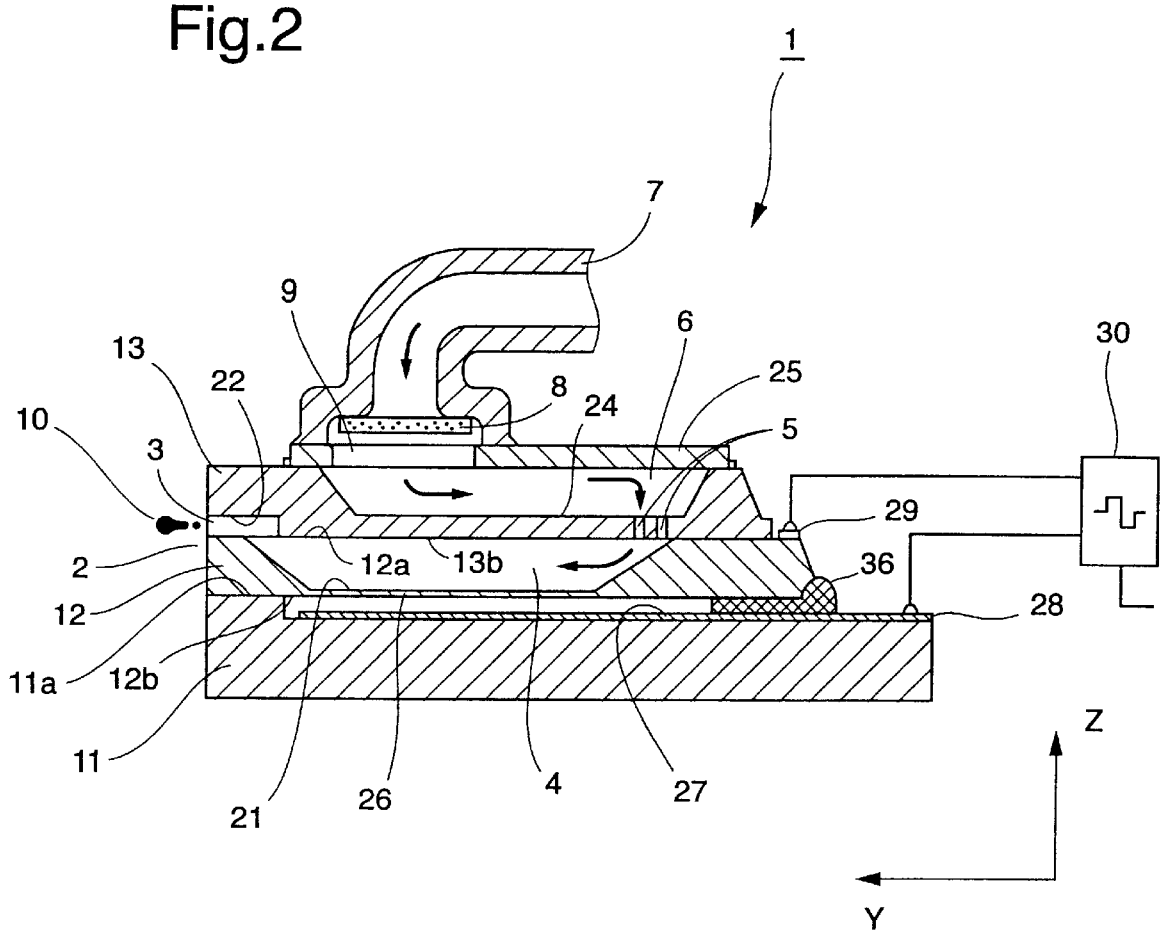
FIG. 2 is a partial cross-sectional view cutting along ink supply pipe 7 of the ink-jet head of FIG. 1 as viewed along line II—II of FIG. 1.
Figure 3:
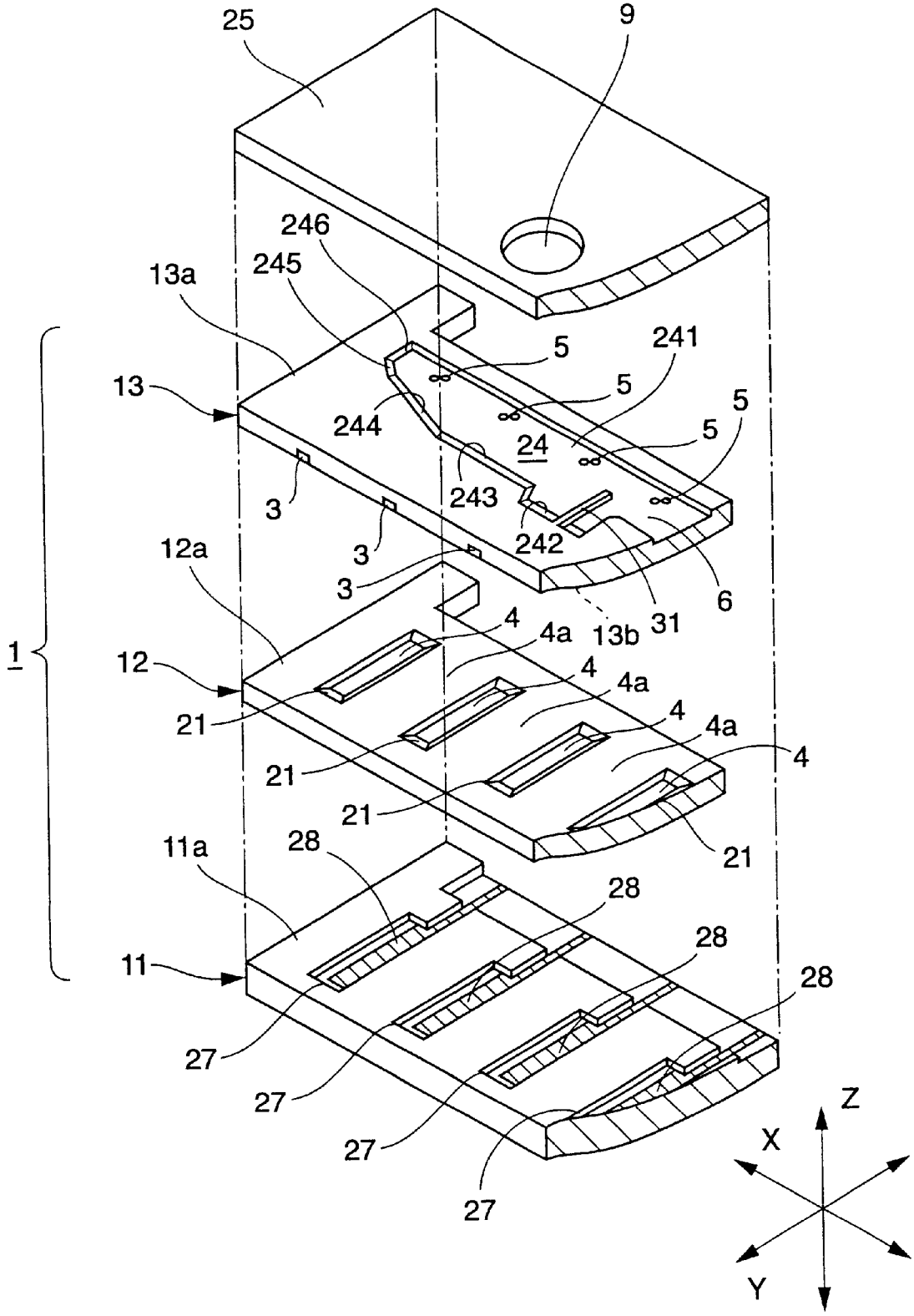
FIG. 3 is an exploded perspective view showing the major portion of the ink-jet head of FIG. 1.

FIG. 1 is a general plan view showing a first embodiment of an electrostatic drive type ink-jet head according to the present invention, FIG. 2 is a general section of the portion taken along line II—II and FIG. 3 is a exploded perspective view showing the major part of the first embodiment of the electrostatic type ink-jet head. Discussion will be given hereinafter with reference to the drawings. The shown embodiment of the ink-jet head 1 has a plurality of ink ejection nozzles 3 arranged in alignment along a width direction X of the head on the front end face 2 thereof. Each ink ejection nozzle 3 is communicated with an ink pressure chamber 4 which is located at the back side in the longitudinal direction Y of the head.

The ink pressure chambers 4 are arranged in a form of array on a plane in alignment in the width direction X of the head in spaced apart relationship with the adjacent chamber via a partitioning wall 4*a*. Each ink pressure chamber 4 is communicated with a common ink chamber 6 an ink supply orifice 5. The common ink chamber 6 is stacked on upper side of each ink pressure chamber 4 in a thickness direction Z of the head. On the upper side of the common ink chamber 6, an ink supply port 9 is formed. An ink supplied from an external ink source (not shown) is supplied into the common ink chamber 6 from the ink supply port 9 via an ink supply pipe 7 and a filter 8.

The volume of each ink pressure chamber 4 is individually variable by means of an electrostatic actuator which will be discussed later. Utilizing pressure variation caused by variation of volume of each ink pressure chamber 4, the ink droplet 10 is ejected from each ink ejection nozzle 3.

Here, the shown embodiment of the ink-jet head 1 has an electrode glass substrate (first substrate) 11, a cavity substrate (second substrate) 12 formed by a monocrystalline silicon substrate laminated on the surface of the first substrate 11, and a nozzle substrate (third substrate) 13 formed by a monocrystalline silicon substrate laminated on the surface of the second substrate 12. These three substrates are stacked in the thickness direction Z of the head.

The cavity substrate 12 sandwiched between the electrode glass substrate 11 and the nozzle substrate 13 is formed with a plurality of grooves 21 for forming the ink pressure chambers on the upper surface 12*a* thereof. On the lower surface 13*b* of the nozzle substrate 13 stacked on the upper surface 12*a* of the cavity substrate 12, ink grooves 22 for forming the ink ejection nozzles extending in the longitudinal direction Y of the head, are formed at the front end portion. On the rear end portion, ink supply orifices 5 extending through the nozzle substrate 13 in the thickness direction Z of the head, are formed.

By laminating the cavity substrate 12 and the nozzle substrate 13, the ink ejection nozzles 3 and the ink pressure chambers 4 are defined. Each ink ejection nozzle 3 is communicated with each ink pressure chamber 4. On the other hand, the ink pressure chamber 4 has a rear end portion where it is communicated with a plurality of ink supply orifices 5.

On the upper surface 13*a* of the nozzle substrate 13, a groove 24 elongated in the lateral or width direction X of the head is formed for defining the common ink chamber. Upper opening of the groove 24 is closed by a film 25 laminated on the surface 13*a* of the nozzle substrate 13 for defining the common ink chamber 6. Through the film 25, the ink supply port 9 is formed. To the ink supply port 9, an end of the ink supply pipe 7 is secured by bonding.

Next, the electrostatic actuator for ejecting the ink droplet from each ink ejection nozzle 3 will be discussed. First, on the bottom portion of each groove 21 formed in the cavity substrate 12 for forming the ink pressure chamber, a vibration plate 26 which is elastically deformable in out-of-plane direction (thickness direction Z of the head), is formed. On the upper surface 11*a* of the electrode glass substrate 11 laminated on the lower surface 12*b* of the cavity substrate 12, a groove 27 of a given depth is formed at a position opposing to the vibration plate 26. On the bottom surface of the groove 27, an individual electrode 28 formed by an ITO film or the like, is formed. Each individual electrode 28 and the vibration plate 26 are opposed with a given clearance therebetween. Each gap formed between them is hermetically sealed by sealing material 36.

When a drive voltage is applied between a common electrode 29 formed at the rear end portion of the upper surface 12*a* of the cavity substrate 12 and each individual electrode 28, an electrostatic attractive force is generated between the vibration plate 26 and the opposing individual electrode 28. By the electrostatic attractive force, the vibration plate 26 is forced to elastically deform toward the individual electrode 28. Immediately after the application of the drive voltage is removed, the electrostatic attractive force vanishes, and the vibration plate 26 moves toward its initial position by its own elastic characteristics. This generates pressure variation in each ink pressure chamber 4, whereby the ink droplet is ejected through the corresponding ink ejection nozzle 3. Since the principle of operation of the electrostatic actuator is per se well known, further detailed discussion will be omitted.

In the ink-jet head 1 of the shown embodiment constructed as set forth above, the common ink chamber 6 is stacked on the ink pressure chambers 4. Accordingly, in comparison with the conventional construction, in which the common ink chamber 6 and the ink pressure chambers 4 are formed on the same plane, the dimension in the length or longitudinal direction Y of the ink-jet head can be made smaller.

On the other hand, the shown embodiment of the ink-jet head 1 has a construction in which three substrates are stacked, and both the nozzle grooves 22 for forming the ink ejection nozzles and the groove 24 for forming the common ink chamber 24 are formed in the nozzle substrate 13. Therefore, it is not necessary to additionally assemble another substrate for arranging the common ink chamber 6 stacked on the ink pressure chambers 4. As a result, upon stacking the common ink chamber on the ink pressure chambers, the increase of the dimension of the head in the thickness direction Z is reduced. Thus, an ink-jet head which is more compact than a conventional one, can be realized. Also, the number of parts can be reduced to facilitate fabrication.

Furthermore, in the shown embodiment, the ink supply orifices 5 are formed vertically (thickness direction Z of the head) in the bottom wall portion of the common ink chamber 6 in the nozzle substrate 13. If the common ink chamber 6 is arranged on the common plane with the ink pressure chambers 4, it becomes necessary to form fine grooves on the surface of the substrate in order to form the ink supply orifices for communicating between the common ink chamber 6 and the ink pressure chamber 4. In comparison with the case of forming the fine grooves on the surface of the substrate, forming through holes in the bottom portion of the common ink chamber 6 for forming the ink supply orifices 5 is easier. Also, a plurality of the ink supply orifices 5 can be formed relatively easily. Furthermore, freedom in designing the section and dimension of the orifice can be increased to facilitate adjustment of flow resistance of the ink supply orifice and thus to facilitate adjustment of the ink ejection characteristics of the ink-jet head 1.

Here, by forming a greater number of ink supply orifices, if one of the orifices is blocked by a foreign matter contained in the ink, significant increase of ink flow resistance will not occur and continuous ink supply can be assured, whereby harmful affect on the ink ejection amount, ink ejection speed, and so forth are avoided.

In the common ink chamber 6 of the shown embodiment of the ink-jet head 1, the inner peripheral side wall 241 extends in the lateral or width direction X of the head on the rear end side of the groove 24. Along the inner peripheral side wall 241 at the rear end side of the head, the ink supply orifices 5 are formed in the bottom portion of the groove 24. In contrast to this, the ink supply port 9 is located in the vicinity of the opposite side end of the common ink chamber 6, namely the inner peripheral side wall 242 at the front end side of the head.

The ink supply ports 9 are formed in the film 25 at both sides in the width direction of the head. At the portions of the common ink chamber 6 opposing to the respective ink supply ports 9, supporting ribs 31 are formed for restricting deflection of the film 25 at the portion where the ink supply ports 9 are formed in out-of-plane direction. Each supporting rib 31 extends rearwardly from the inner peripheral side wall 242 of the common ink chamber 6 and diametrically over the corresponding ink supply port 9 for supporting diametrically opposing both inner edge portions of the ink supply port 9.

In the shown embodiment, the shape of the common ink chamber 6 in plan view is symmetrical shape about the longitudinal center axis of the head and is widened from the ink supply port 9 to the ink supply orifices. Namely, the groove 24 defining the common ink chamber 6 is defined by the front and rear inner peripheral side walls 242 and 241, a pair of left and right inner peripheral side walls 243 extending laterally at the position rearwardly shifted from the position of the inner peripheral wall 242, a pair of inner peripheral side walls 244 extending from ends of the inner peripheral side walls 243 with inclination angles of 19°, a pair of inner peripheral wall 245 extending from ends of the inner peripheral end walls 244 with inclination angles of 45° with respect to the inner peripheral walls 243, and a pair of inner peripheral walls 246 extending in directions perpendicular to the extending direction of the inner peripheral walls 243 and joined with the inner peripheral wall 241 on the rear side.

In the shown embodiment, the groove 24 forming the common ink chamber is formed by way of anisotropic wet etching of the surface of the monocrystalline silicon substrate having crystal face orientation (100), and the directions of the inner peripheral side walls 241 and 242 and the inner peripheral side walls 243 are parallel to (011) of face orientation. As a result, the inner peripheral walls 244 have faces extending with inclination of 19° relative to the face orientation (011), and the inner peripheral walls 245 have faces extending with inclination of 45° relative to the face orientation of 246.

In the ink-jet head 1 of the shown embodiment, the ink supply ports 9 are formed on one side (front side in the shown embodiment) in the plane direction of the common ink chamber 6, and the ink supply orifices 5 are formed on the other side (rear side in the shown embodiment). As viewed in plan view, the common ink chamber 6 has a rearwardly ascending shape as defined in the inner peripheral side walls 244, 245 and 246.

With such shape of the common ink chamber 6, the ink introduced into the common ink chamber 6 through the ink supply ports 9 can quickly flow toward the ink supply orifices 5 in the common ink chamber 6 without stagnation therein. Accordingly, accumulation of bubble in the common ink chamber 6 due to stagnation of the ink therein can be successfully prevented or restricted. Particularly, stagnation of the ink at the corner portion of the common ink chamber 6 at both end portions in the lateral or width direction X can be prevented or restricted.

On the other hand, in the groove 24 for forming the common ink chamber in the shown embodiment, since the direction of the inner peripheral side walls 241 to 246 are defined as set forth above, the inner peripheral side walls can be easily formed to have a flat surface during formation of the groove 24 by way of antistrophic wet etching. By forming the respective inner peripheral side walls of the common ink chamber to have a flat surface, flow of the ink in the common ink chamber becomes smooth to contribute to restriction or elimination of stagnation of bubble therein.

It should be noted that the shown embodiment of the ink-jet head 1 is an edge nozzle type having the ink ejection nozzles on the front end face of the ink-jet head. However, the present invention is equally applicable for a face nozzle type which has the ink ejection nozzles opened on the surface of the ink jet head.

On the other hand, the shown embodiment of the ink-jet head 1 can be employed as the ink-jet head for a serial type ink-jet printer performing printing by ejecting the ink droplet onto a printing medium with scanning the ink-jet head thereon. Also, by aligning a plurality of the shown embodiment of the ink-jet heads for forming an ink-jet head unit for a length of printing one line, the shown embodiment of the ink-jet head can be used as the line ink-jet head to be employed in a line type ink-jet printer performing printing by ejecting ink droplet toward the printing medium with scanning the printing medium in auxiliary scanning direction (paper feeding direction).

(Fabrication Process of Ink-Jet Head)

Next, the ink-jet head 1 constructed as set forth above can be produced by individually fabricating the nozzle substrate 13, the cavity substrate 12 and the electrode glass substrate 11, and laminating those three substrates. The cavity substrate 12 and the electrode glass substrate 11 may be fabricated by a known method as disclosed in the formally referenced U.S. Pat. No. 5,513,431, the content of which is incorporated herein by reference.

Figure 4:
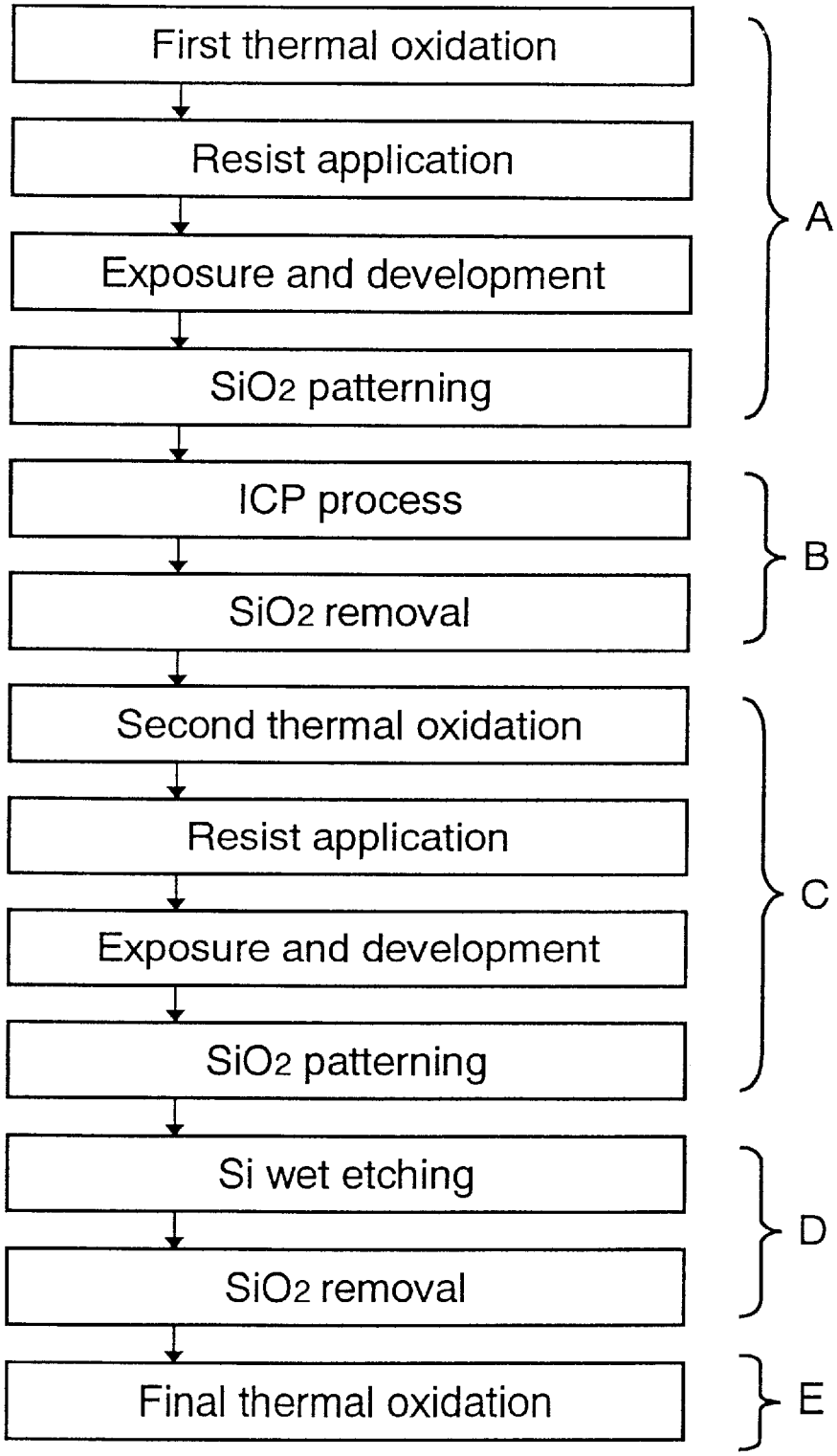
FIG. 4 is a general flowchart showing a fabrication process of a nozzle plate in the ink-jet head of FIG. 1.

Accordingly, discussion will be given hereinafter for the fabrication process of the nozzle substrate having the nozzle grooves 22 for forming the ink ejection nozzles and the groove 24 for forming the common ink chamber with reference to the flowchart in FIG. 4 and explanatory illustrations shown in FIGS. 5(A) to 5(*d*).

(Formation of First Thermal Oxidation Film and Patterning Process A)

First, a predetermined thickness of silicon wafer 100 is provided. By thermal oxidation of the silicon wafer 100, $SiO_2$ film serving as resist film is formed over the entire surface. Next, a resist (photosensitive resin) is applied by a spin coating. Then, the resist is exposed and developed to form orifice forming portions 230 for forming through openings 23 for forming the ink supply orifices, and nozzle groove forming portions 220 for forming the nozzle grooves 22 for forming the ink ejection nozzles are opened. Thereafter, patterning of the $SiO_2$ film is performed by BHF (ammonium fluoride). Then, the resist is removed.

Figure 5:
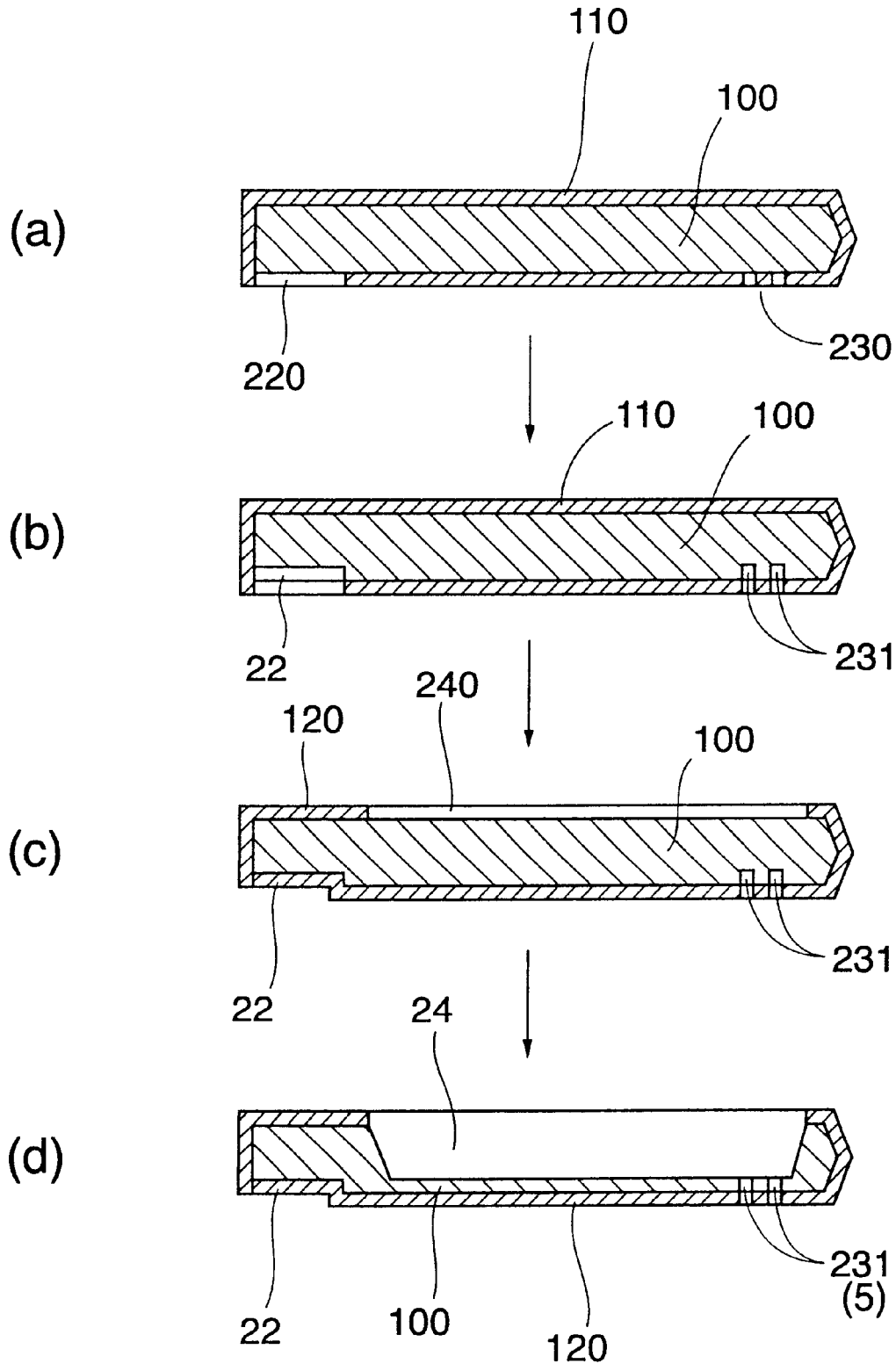
FIGS. 5(*a*) to 5(*d*) are explanatory illustration for explaining respective fabrication process of the nozzle plate.

As a result, as shown in FIG. 5(*a*), in the $SiO_2$ film 110 covering the surface of the silicon wafer 100, the orifice forming portions 230 for forming the ink supply orifices and the nozzle groove forming portions 220 for forming the nozzle grooves are patterned.

(Dry Etching Process B)

Then, as shown in FIG. 5B, trench etching by ICP discharge is performed for the silicon wafer 100. By this, in the shape corresponding to the pattern on the $SiO_2$ film, the surface of the silicon wafer 100 is etched in the direction perpendicular to the surface to form a plurality of blind holes 231 of predetermined depth are formed in the orifice forming portions 230 for forming the through openings for serving as the ink supply orifices. Also, the nozzle grooves 22 for ink ejection nozzles are formed in the nozzle groove forming portions 220. After etching, the $SiO_2$ film is removed.

(Formation of Second Thermal Oxidation Film and Patterning Process C)

Subsequently, thermal oxidation is applied on the silicon wafer again to form $SiO_2$ film serving as the resist film is formed over the entire surface. Then, by way of spin coating, the resist (photosensitive resin) is applied. Then, the resist is exposed and developed to form a groove forming portion for forming the groove 24 for formation of the common ink chamber. Thereafter, the $SiO_2$ film is patterned by BHF (ammonium fluoride). Then, the resist of the photosensitive resin is removed.

As a result, as shown in FIG. 5(*c*), the groove forming portion 240 for forming the groove 24 for forming the common ink chamber is patterned.

(Wet Etching Process D)

Thereafter, the silicon wafer 100 is dipped into an etching fluid (KOH or the like) to perform anisotropic etching on the exposed portion 240 of the silicon wafer. The surface of the silicon wafer has crystal face orientation of (100). Etching is progressed along the surface of crystal face orientation (111) to form the predetermined depth of the groove 24.

As the etching fluid for the silicon wafer 100, that having a 25% of KOH may be employed, wherein etching of the silicon wafer is carried out at about 80° C. In order to obtain a smoother etched surface, an etching fluid having 29% of KOH and 20% of ethanol may be used, wherein an etching temperature is maintained about 65° C.

As a result as shown in FIG. 5(*d*), in the groove 24 for forming the common ink chamber, the predetermined depth of blind openings 231 are formed from the opposite side by trench etching as set forth above. By adjusting the depth of the groove 24 for communication with the blind holes 231, the blind hole 231 becomes through openings for serving as the ink supply orifices.

After anisotropic etching, $SiO_2$ film 120 is removed.

(Final Thermal Oxidation Process)

Finally, in order to certainly provide ink corrosion resistance of the silicon wafer and adhesion ability of water repellent coating of the nozzle surface, thermal oxidation is performed for the silicon wafer to form $SiO_2$. Through the foregoing process, the nozzle plate 2 is obtained.

Modification of First Embodiment)

Figure 6:
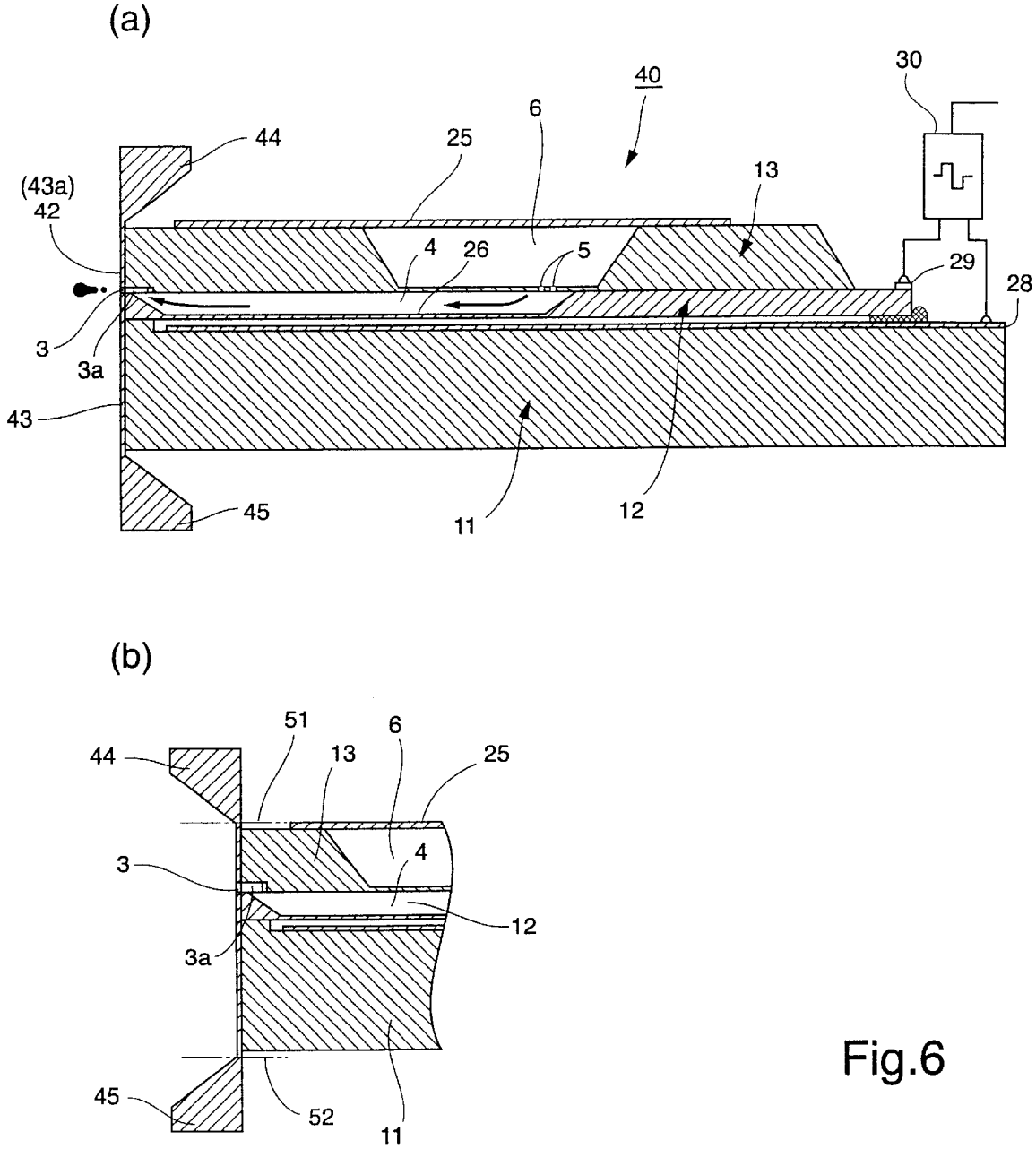
FIGS. 6(*a*) and 6(*b*) are general sectional views showing modification of the ink-jet head of FIG. 1.

FIG. 6(*a*) is a general section showing a modification of the ink-jet head 1 set forth above. The shown embodiment of the ink-jet head 40 is designed to form the ink ejection nozzles 3 by firmly bonding separately fabricated nozzle plate 43 (a fourth substrate) on the front end face 42. Namely, in the nozzle plate 43, ink ejection nozzles 3 are formed therethrough. The ink ejection nozzles 3 are communicated with nozzle communication holes 3*a* formed on the front end face 42 of the head. The nozzle communication holes 3*a* are communicated with respectively corresponding ink pressure chambers 4. Since the construction set forth above is essentially the same as the ink-jet head 1, like components will be identified by the same reference numerals and detailed discussion for the common components will be omitted in order to avoid redundant discussion and whereby to keep the disclosure simple enough to facilitate clear understanding of the present invention.

When a predetermined thickness of the nozzle plate 43 is provided and through holes for forming the ink ejection nozzles are formed, since shape management of the through hole is easy, characteristics of the ink ejection nozzles 3 can be easily adjusted.

Furthermore, when the nozzle plate 43 is employed, good adhesion ability of an ink repellent film applied on the surface 43*a* (front end face 42 of the nozzle) for making flying direction of the ink droplets uniform. Namely, as in the shown embodiment, in comparison with the case where the ink repellent film is applied to the nozzle front end face formed by the front end faces of the laminated substrates 12 and 13, better adhesion ability can be achieved by application of the ink repellent film on the surface 43*a* of the nozzle plate 43 formed by the single material.

Also, the nozzle communication holes 3*a* formed in the substrate 13 can be set the shape and dimension relatively freely different from the ink ejection nozzles 3 affecting ink ejection characteristics or the like. Accordingly, by providing greater ink flow area for the nozzle communication holes 3*a* than that of the ink ejection nozzles 3, possibility of blocking of the nozzle communication holes 3*a* by plugging the foreign matter therein upon opening the ink communication holes 3*a* by cutting or grinding.

It should be noted that since the nozzle plate 43 is thin, reinforcement ribs 44 and 45 are typically formed on both end portions. These reinforcement ribs 44 and 45 may be maintained as they are, as illustrated in FIG. 6(*a*). It is also possible to cut the reinforcement ribs 44 and 45 away at the upper and lower edge portions of the nozzle front end face 42.

Particularly, as shown in FIG. 6(*b*), when the reinforcement ribs 44 and 45 project frontwardly from the ink-jet head, the reinforcement ribs 44 and 45 are cut out at positions indicated by one dotted lines 51 and 52 so that the reinforcement ribs 44 and 45 will not interfere feeding of the printing paper or the like.

The material of the nozzle plate 43 may be a silicon that is the same as the silicon substrate 13. In this case, the ink ejection nozzles 3 can be formed in the same processing manner as the ink supply orifices 5 in the nozzle substrate 13. Thus, the processing apparatus to be employed for processing the nozzle substrate 13 may also be used for processing the nozzle plate 43 to make processing operation reasonable and simple.

When the nozzle substrate 13 and the nozzle plate 43 are formed of the same material having the same linear expansion coefficient, even when environmental temperature is repeatedly varied, peeling off of the nozzle plate 43 from the nozzle substrate 13 due to difference of the linear expansion coefficient will never be caused. This, since reliability of bonding of the nozzle plate 43 is high, facilitates the formation of the ink-jet head with multiple nozzle structure employing a large size nozzle plate 43 having a large number of ink ejection nozzles.

As material of the nozzle plate 43, resin, such as polyimide film or the like, may also be employed. In this case, after bonding the nozzle plate which is not formed with the ink ejection nozzles on the front end face 42 of the head, the ink ejection nozzles can be provided in the nozzle plate by laser processing. By employing this processing method, it becomes unnecessary to perform position matching between the ink ejection nozzles and the ink communication holes to facilitate bonding operation of the nozzle plate.

On the other hand, as a material of the nozzle plate 43, the stainless steel may also be employed. In this case, in the fabrication process of the nozzle plate, cracking or defect of the nozzle material will not be caused to facilitate fabrication.

Second Embodiment

Figure 7:
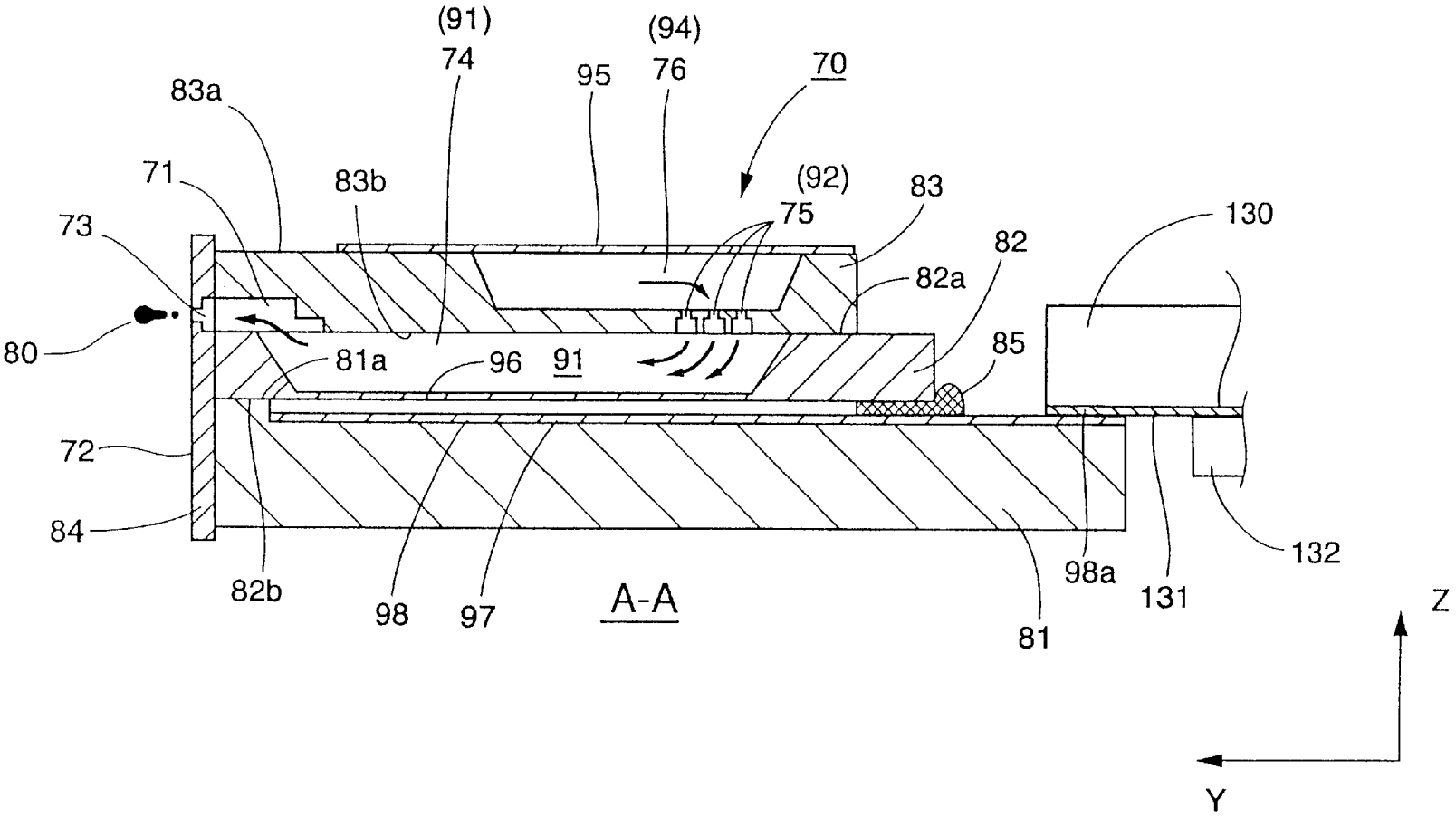
FIG. 7 is a general section of a line type ink-jet head, to which the present invention is applied.
Figure 8:
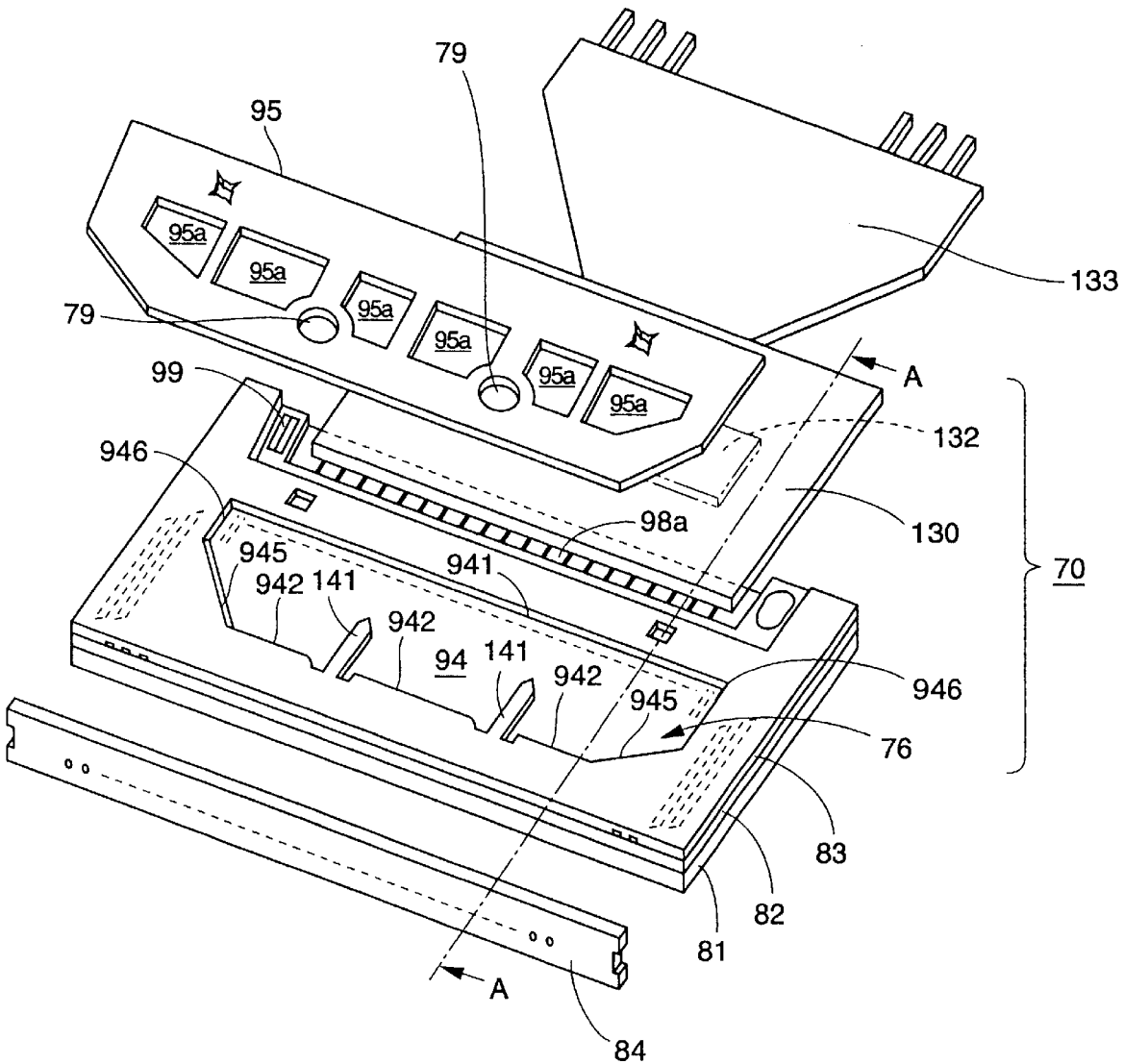
FIG. 8 is a perspective view showing the major part of the ink-jet head of FIG. 7.

Next, FIGS. 7 and 8 show longitudinal section showing one example of a line type ink-jet head to which the present invention is applied, and exploded perspective view of the major part thereof. Discussion will be given with reference to these drawings. The shown embodiment of the ink-jet head 70 has a plurality of ink ejection nozzles arranged in alignment along the width direction X of the head on the front end face 72. Each ink ejection nozzle 73 is communicated, through nozzle communication holes 71 formed on the rear side in the longitudinal direction of the head, with the ink pressure chambers 74 formed on the rear side of the nozzle communication holes.

The ink pressure chambers 74 are arranged in the width direction X of the head in the plane direction in spaced apart relationship with each other via partitioning walls (not shown). Each ink pressure chamber 74 is communicated with the common ink chamber 76 via respective ink supply orifices 75. The common ink chamber 76 is stacked on the upper side of the ink pressure chambers 74 in thickness direction Z of the head. In the upper side of the common ink chamber 76, the ink supply ports 79 are formed. The ink supplied from the external ink source (not shown) is introduced into the common ink chamber 76 through the ink supply ports 79 via ink supply pipes (not shown) and filters (not shown).

Each ink pressure chamber 74 is variable of volume independently by an electrostatic actuator which will be discussed later. Utilizing pressure variation caused by variation of volume of the ink pressure chamber 74, the ink droplet 80 is ejected from each ink ejection nozzle 73.

The shown embodiment of the ink-jet head 70 has a glass substrate (first substrate) 81, a silicon substrate (second substrate) 82 formed by a monocrystalline silicon substrate laminated on the surface of the first substrate 81, a silicon substrate (third substrate) 83 formed by a monocrystalline silicon substrate laminated on the surface of the second substrate 82 and a nozzle substrate (fourth substrate) formed by the same monocrystalline silicon substrate. Three substrates 81, 82 and 83 are stacked in the thickness direction Z of the head. On the front end face of the stacked substrates 81, 82 and 83, a nozzle plate 84 formed with the ink ejection nozzles 73 is bonded.

The silicon substrate 82 sandwiched between the glass substrate 81 and the silicon substrate 83 is formed with a plurality of grooves 91 for forming the ink pressure chambers on the upper surface 82*a* thereof. On the lower surface 83*b* of the silicon substrate 83 stacked on the upper surface 82*a* of the silicon substrate 82, communication grooves 92 for forming the nozzle communication holes extending in the longitudinal direction Y of the head, are formed at the front end portion. On the rear end portion, ink supply orifices 75 extending through the silicon substrate 83 in the thickness direction Z of the head, are formed.

By laminating the silicon substrates 82 and 83, the nozzle communication holes 71 and the ink pressure chambers 74 are defined. Each nozzle communication hole 71 is communicated with each ink pressure chamber 74. On the other hand, rear end portion of the ink pressure chamber 74 is communicated with a plurality of ink supply orifices 75.

On the upper surface 83*a* of the silicon substrate 83, a groove 94 elongated in the lateral or width direction X of the head is formed for defining the common ink chamber. Upper opening of the groove 94 is closed by a film 95 laminated on the surface 83*a* of the silicon substrate 83 for defining the common ink chamber 76. This film 95 is formed with two ink supply ports 79, to which, not shown ink supply pipes are connected. The film 95 is manufactured by laminating a stainless steel thin film and a resin thin film, and then etching predetermined portions 95*a* of the stainless steel thin film. The laminate structure of the film 95 formed by the stainless steel thin film and the resin thin film, makes it possible to increase compliance of the common ink chamber, and at the same time to secure an appropriate strength required for connecting portions of the ink supply pipes and the like. The film 95 may be a stainless steel thin film.

Next, the electrostatic actuator for ejecting the ink droplet from each ink ejection nozzle 73 will be discussed. At first, on the bottom portion of each groove 91 formed in the silicon substrate 82 for forming the ink pressure chamber, a vibration plate 96 which is elastically deformable in out-of-plane direction (thickness direction Z of the head), is formed. On the upper surface 81*a* of the glass substrate 81 laminated on the lower surface 82*b* of the silicon substrate 82, a groove 97 of a given depth is formed at a position opposing to the vibration plate 96. On the bottom surface of the groove 97, an individual electrode 98 formed by an ITO film or the like, is formed. Each individual electrode 98 and the vibration plate 96 are opposed with a given clearance therebetween.

A common electrode terminal 99 formed at the rear end portion of the upper surface 82*a* of the silicon substrate 82 and individual electrode terminals 98*a* lead rear side of the head via a seal portion 80 from the individual electrode 98 are connected by a wiring pattern 131 formed on a relay substrate 130. On the relay substrate 130, an IC chip 132 mounting a head driver or the like is mounted. To the relay substrate, a flexible circuit board 133 for external wiring is connected. When a drive voltage is applied between a common electrode 99 and each individual electrode 98, an electrostatic attractive force is generated between the vibration plate 96 and the individual electrode 98. By the electrostatic attractive force, the vibration plate 96 is forced to deform elastically toward the opposing individual electrode 28. Immediately after the application of the drive voltage is stopped, since the electrostatic attractive force is disappeared, the vibration plate 26 moves by its own elastic characteristics toward its initial position. As a result, pressure change is generated in the ink pressure chamber 74, whereby the ink droplet is ejected from the corresponding ink ejection nozzle 73. Since the principle of operation of the electrostatic actuator is per se well known. Therefore, further detailed discussion will be omitted.

The line type ink-jet head 70 of the shown embodiment constructed as set forth above has a construction, in which the common ink chamber 76 is stacked on the ink pressure chambers 74. Accordingly, in comparison with the conventional construction, in which the common ink chamber 76 and the ink pressure chambers 74 are formed on the same plane, the dimension in the length or longitudinal direction Y of the ink-jet head can be made smaller.

On the other hand, in the shown embodiment of the ink-jet head 70, the communication grooves 92 for forming the nozzle communication holes communicated with the ink ejection nozzles 73 and the groove 94 for forming the common ink chamber are formed in the silicon substrate 83. Therefore, it is not necessary to additionally assemble another substrate for arranging the common ink chamber 76 stacking on the ink pressure chambers 74. As a result, upon stacking the common ink chamber on the ink pressure chambers, the increase of the dimension of the head in the thickness direction Z can be reduced. Thus, the ink-jet head which is more compact than the conventional one, can be realized. Also, number of parts can be reduced to facilitate fabrication.

Furthermore, in the shown embodiment, the ink supply orifices 75 are formed vertically (thickness direction Z of the head) in the bottom wall portion of the common ink chamber 76 in the nozzle substrate 83. If the common ink chamber 76 is arranged on the common plane with the ink pressure chambers 74, it becomes necessary to form fine grooves on the surface of the substrate in order to form the ink supply orifices for communicating between the common ink chamber 76 and the ink pressure chamber 74. In comparison with the case of forming the fine grooves on the surface of the substrate, forming through holes in the bottom portion of the common ink chamber 76 for forming the ink supply orifices 75 is easier. Also, a plurality of the ink supply orifices 75 can be formed relatively easily. Furthermore, freedom in the designing the section and dimension of the orifice can be increased to facilitate adjustment of flow resistance of the ink supply orifice and thus to facilitate adjustment of the ink ejection characteristics of the ink-jet head 70.

Here, by forming a greater number of ink supply orifices, if one of the orifices is blocked by a foreign matter contained in the ink, significant increase of ink flow resistance will not be caused to permit continuing of ink supply to avoid harmful affect for the ink ejection amount, ink ejection speed and so forth.

When a predetermined thickness of the nozzle plate 84 provided with the ink ejection nozzles 73 are bonded on the front end face of the laminated three substrates 81, 82 and 83. Since shape management of the through hole is easy in formation of the through holes for the ink ejection nozzles in the substrate, characteristics of the ink ejection nozzles 73 can be easily adjusted.

Furthermore, when the nozzle plate 84 is employed, good adhesion ability of an ink repellent film applied on the surface (front end face 72 of the nozzle) for making flying direction of the ink droplets uniform. Namely, as in the first embodiment, in comparison with the case where the ink repellent film is applied to the nozzle front end face formed by the front end faces of the laminated substrates 12 and 13, better adhesion ability can be achieved by application of the ink repellent film on the surface of the nozzle plate 84 formed with the single material.

Also, the nozzle communication holes 71 formed in the substrate 83 can be set the shape and dimension relatively freely different from the ink ejection nozzles 73 affecting for ink ejection characteristics or the like. Accordingly, as in the first embodiment, by providing greater ink flow area for the nozzle communication holes 71 than that of the ink ejection nozzles 73, possibility of blocking of the nozzle communication holes 71 by plugging the foreign matter therein upon opening the ink communication holes 71 by cutting.

The material of the nozzle plate 84 may be a silicon the same as the silicon substrate 83. In this case, the ink ejection nozzles 73 can be formed in the same processing manner as the ink supply orifices 75 in the silicon substrate 83. Thus, the processing apparatus to be employed for processing the silicon substrate 83 may also be used for processing the nozzle plate 84 to make processing operation reasonable and simple.

When the silicon substrate 83 and the nozzle plate 84 are formed of the same silicon material having the same linear expansion coefficient, even when environmental temperature is repeatedly varied, peeling off of the nozzle plate 84 from the nozzle substrate 13 due to difference of the linear expansion coefficient will never be caused. This, since reliability of bonding of the nozzle plate 84 is high, it is facilitated to form the line type ink-jet head with multiple nozzle structure employing a large size nozzle plate 84.

As material of the nozzle plate 84, resin, such as polyimide film or the like, may also be employed. In this case, after bonding the nozzle plate which is not formed with the ink ejection nozzles on the front end face 72 of the head, the ink ejection nozzles can be provided in the nozzle plate by laser processing. By employing this processing method, it becomes unnecessary to perform position matching between the ink ejection nozzles and the ink communication holes to facilitate bonding operation of the nozzle plate.

On the other hand, as a material of the nozzle plate 43, the stainless steel may also be employed. In this case, in the fabrication process of the nozzle plate, cracking or defect of the nozzle material will not be caused to facilitate fabrication.

In the common ink chamber 76 of the shown embodiment of the ink-jet head 70, the inner peripheral side wall 941 extends in the lateral or width direction X of the head on the rear end side of the groove 94. Along the inner peripheral side wall 941 at the rear end side of the head, the ink supply orifices 75 are formed in the bottom portion of the groove 94. In contrast to this, the ink supply port 79 is located in the vicinity of the opposite side end of the common ink chamber 76, namely the inner peripheral side wall 942 at the front end side of the head.

The ink supply ports 79 are formed in the film 95 at both sides in the width direction of the head. At the portions of the common ink chamber 76 opposing to respective ink supply ports 79, supporting ribs 141 are formed for restricting deflection of the film 95 at the portion where the ink supply ports 79 are formed in out-of-plane direction. Each supporting rib 141 extends rearwardly from the inner peripheral side wall 942 of the common ink chamber 76 and diametrically over the corresponding ink supply port 79 for supporting diametrically opposing both inner edge portion of the ink supply port 79.

In the shown embodiment, the shape of the common ink chamber 76 in plan view is symmetrical shape about the longitudinal center axis of the head and is widen from the ink supply port 79 to the ink supply orifices 75. Namely, the groove 94 defining the common ink chamber 76 is defined by the front and rear inner peripheral side walls 942 and 941, a pair of inner peripheral wall 945 extending from ends of the inner peripheral end walls 942 with inclination angles of 45° and a pair of inner peripheral walls 946 extending in directions perpendicular to the extending direction of the inner peripheral walls 942 and joined with the inner peripheral wall 941 on the rear side.

In the shown embodiment, the groove 94 for forming the common ink chamber is formed by way of anisotropic wet etching of the surface of the monocrystalline silicon substrate having crystal face orientation (100), and the directions of the inner peripheral side walls 941 and 942 and the inner peripheral side walls 243 is parallel to (011) of face orientation. As a result, the inner peripheral walls 945 are faces extending with inclination of 45° relative to the face orientation (011).

In the ink-jet head 70 of the shown embodiment, the ink supply ports 79 are formed on one side (front side in the shown embodiment) in the plane direction of the common ink chamber 76, and the ink supply orifices 75 are formed on the other side (rear side in the shown embodiment). As viewed in plan view, the common ink chamber 76 has a rearwardly ascending shape as defined in the inner peripheral side walls 945 from the ink supply ports 79 to the ink supply orifices 75.

With such shape of the common ink chamber 76, the ink introduced into the common ink chamber 76 through the ink supply ports 79 can be quickly flow within the common ink chamber 76 without stagnation therein. Accordingly, accumulation of bubble in the common ink chamber 76 due to stagnation of the ink therein can be successfully prevented or restricted. Particularly, stagnation of the ink at the corner portion of the common ink chamber 76 at both end portions in the lateral or width direction X can be prevented or restricted.

On the other hand, in the groove 94 for forming the common ink chamber in the shown embodiment, since the orientations of the inner peripheral side walls 941, 942, 945 and 946 is defined as set forth above, the inner peripheral side walls can be easily formed into flat surfaces during formation of the groove 94 by way of antistrophic wet etching. By forming respective inner peripheral side walls of the common ink chamber as flat surfaces, flow of the ink in the common ink chamber becomes smooth to contribute for restriction or elimination of stagnation of bubble therein.

(Line Type Ink-Jet Printer)

Figure 9:
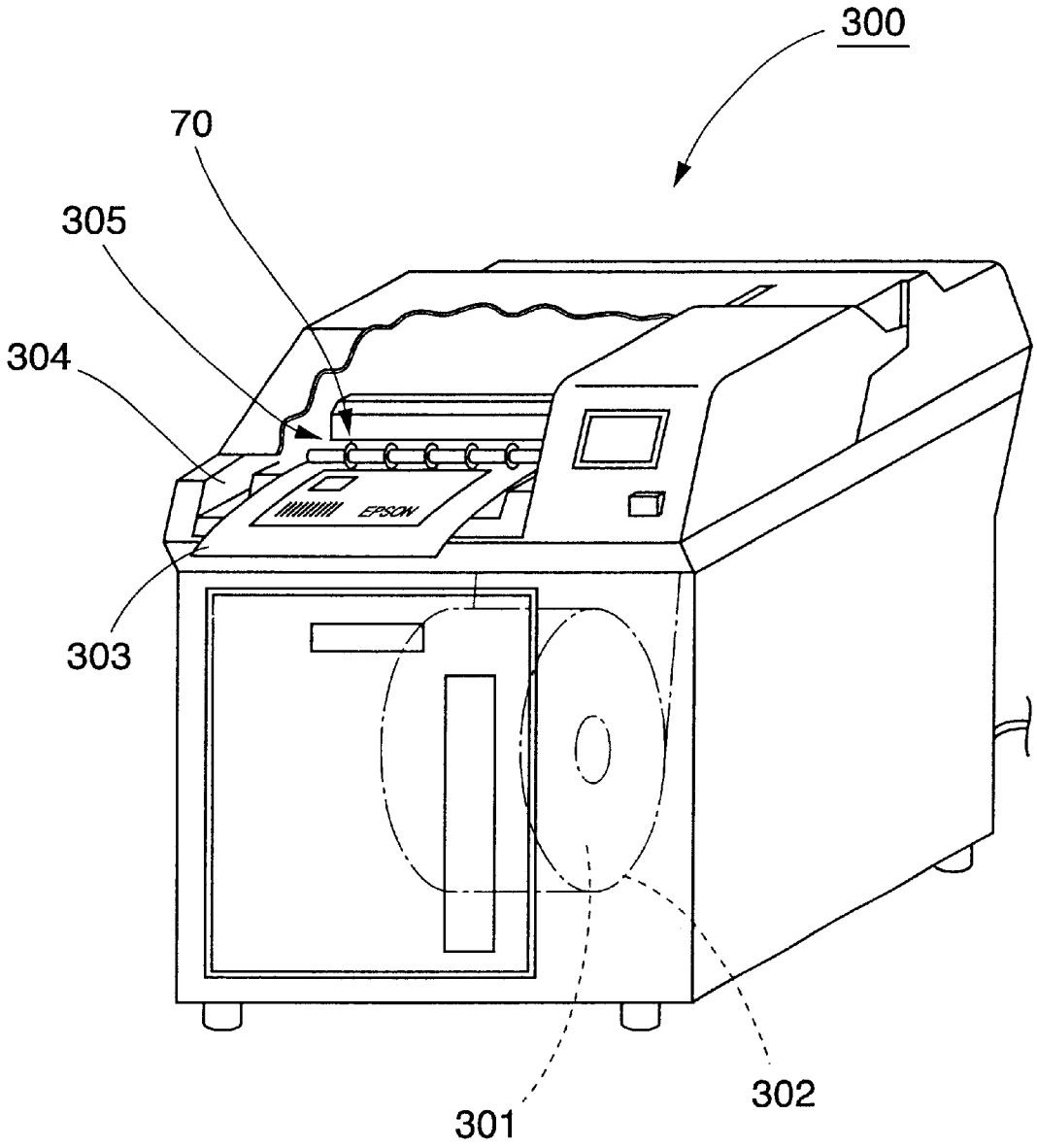
FIG. 9 is an external perspective view showing one example of the ink-jet printer mounting the ink-jet head of FIG. 7.
Figure 10:
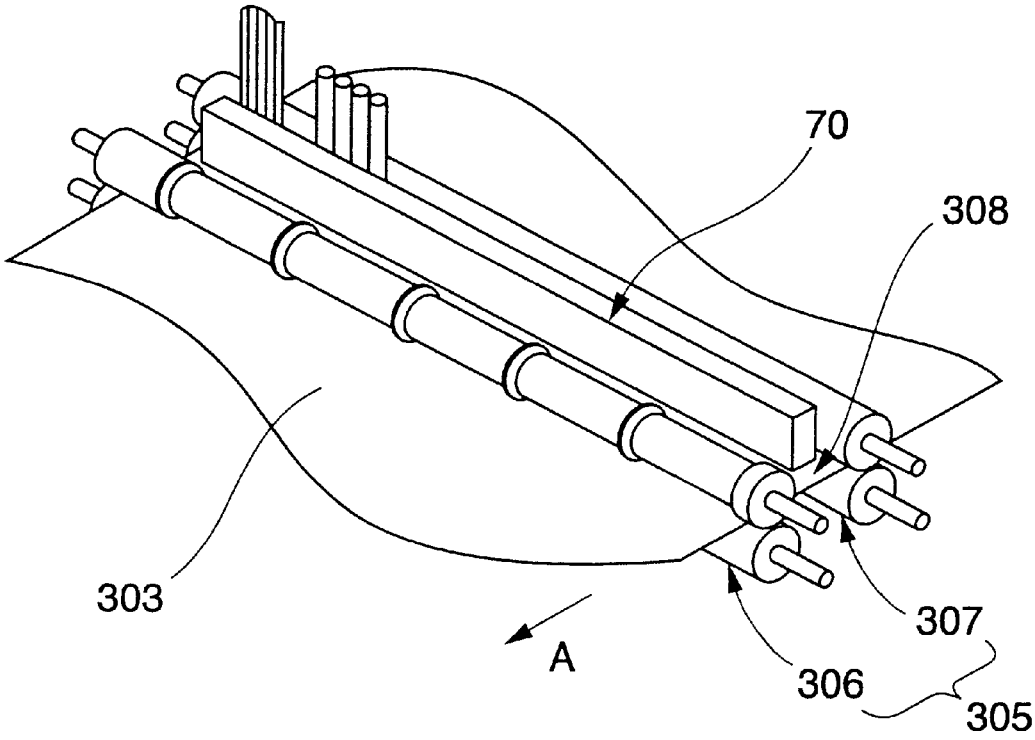
FIG. 10 is a partial perspective view showing a mounting portion of the ink-jet head in the ink-jet printer of FIG. 9.

FIG. 9 is an external perspective view showing one example of the ink-jet printer mounting the ink-jet head of FIG. 7, and FIG. 10 is a partial perspective view showing a mounting portion of the ink-jet head in the ink-jet printer of FIG. 9.

As shown in FIGS. 9 and 10, the shown embodiment of an ink-jet printer 300 includes a receptacle portion 302 of a tape form printing paper roll 301, a feeding mechanism 305 extracting the tape form printing paper 303, feeding the extracted printing paper along a predetermined feeding path and ejecting from an ejection opening 304, and the line type ink-jet head 70 performing printing on the tape form printing paper 303 fed thereacross. As can be seen from FIG. 10, the ink-jet head 70 is the line type ink-jet head having a length covering all printing width of the tape form printing paper 303. On upstream side and downstream side of a printing position 308 where printing is performed by means of the ink-jet head 70, feeding roller pair 306 and 307 are arranged. By the feeding mechanism 305 including the feeding roller pair 306 and 307, the tape form printing paper 303 is fed across the printing position in the direction shown by arrow A. Then, on the surface of the tape form printing paper 303 fed across the printing position, predetermined printing operation is performed by means of the ink-jet head 70.

In the shown embodiment of the ink-jet printer 300, since the longitudinal length of the ink-jet head 70 mounted thereon is short, the ink-jet head mounting space becomes small. Accordingly, the ink-jet printer can be made compact.

In the ink-jet head 70, the ink may flow through the common ink chamber 76 formed therein smoothly without generating bubble stagnation. Therefore, degradation of characteristics of ink ejection of each ink ejection nozzle due to presence of bubble or the like, can be prevented. Thus, high quality printing can be performed by the shown embodiment of the ink-jet printer 300.

As set forth above, the ink-jet head according to the present invention can shorten the length of the ink-jet head by employing a construction, in which the common ink chamber is stacked on the ink pressure chambers arranged on the same plane.

On the other hand, in the present invention, the ink-jet head is constructed by laminating three substrates, and the groove for forming the common ink chamber is formed in the substrate, on which the nozzle grooves for forming the nozzle ejection nozzles or nozzle communication holes are formed. Accordingly, it becomes not necessary for stack other substrate for stacking the common ink chamber. Therefore, increasing of the dimension of the ink-jet head in thickness direction can be restricted. Thus, the compact ink-jet head as a whole can be realized.

Furthermore, the ink supply orifices communicating each ink pressure chamber and the common ink chamber can be formed by forming the through opening extending in the thickness of the ink-jet head in the substrate portion separating between the ink pressure chambers and the common ink chamber. Therefore, in comparison with the case where grooves for forming the ink supply orifices are formed on the surface of the substrate, the ink supply orifices are formed easily. Also, dimension can be managed easily. Furthermore, since a plurality of ink supply orifices can be formed easily, the characteristics of the ink supply orifices, such as flow resistance or the like, can be adjusted easily.

On the other hand, in the ink-jet head according to the present invention, in the common ink chamber supplying ink to respective ink pressure chambers, as viewed in plane view, the ink supply orifices communicated with the ink pressure chambers and the ink supply ports are arranged at opposite sides. Also, the planar shape of the common ink chamber is tapered to be widen from the ink supply ports to the ink supply orifices.

Accordingly, according to the present invention, ink may smoothly flow from the ink supply ports to the ink supply orifices without causing stagnation. Therefore, it can successfully prevent stagnation of the ink in the common ink chamber, particularly in the corner portion in the common ink chamber, and thus can prevent accumulation of bubble in the common ink chamber to successfully avoid ink supply failure from the ink supply orifices to the ink pressure chambers. As a result, uniform ink ejecting operation can be performed from all of the ink ejection nozzles to certainly prevent degradation of printing quality due to stagnation of bubble in the common ink chamber.

On the other hand, upon forming of the groove portion for defining the common ink chamber of the shape set forth above by anisotropic wet etching, by setting the orientation of respective inner peripheral side faces defining the groove, flat inner peripheral side faces can be formed. Accordingly, flow of the common ink chamber can be smoothed to certainly prevent stagnation of bubble in the common ink chamber.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. An ink-jet head comprising:

a plurality of ink ejection nozzles;

a plurality of ink pressure chambers having a one-to-one correspondence with said ink ejection nozzles and respectively communicated with the corresponding ink ejection nozzles;

a common ink chamber for supplying an ink to said plurality of ink pressure chambers;

a plurality of ink supply orifices communicating respective ink pressure chambers with said common ink chamber; and electrostatic actuators for varying the volume of selected ink pressure chambers by an electrostatic force for ejection of ink droplets from said corresponding ink ejection nozzles;

wherein a group of ink pressure chambers within said plurality of ink pressure chambers are arranged in a plane and said common ink chamber is stacked on said group of ink pressure chambers.

2. An ink-jet head as set forth in claim 1, which includes a first substrate, a second substrate stacked on an upper surface of said first substrate and a third substrate stacked on an upper surface of said second substrate;

said third substrate being formed with said common ink chamber and said ink supply orifices;

said second substrate being formed with said ink pressure chambers communicated with said ink ejection nozzles; and said electrostatic actuators being disposed between said first substrate and said second substrate.

3. An ink-jet head as set forth in claim 2, further including:

nozzle grooves for forming said ink ejection nozzles, said nozzle grooves being formed on a lower surface of said third substrate opposing said second substrate;

second grooves for forming said ink pressure chambers, said second grooves being formed on an upper surface of said second substrate.

4. An ink-jet head as set forth in claim 2, which further comprises a fourth substrate formed with said ink ejection nozzles, and ink communication holes communicated with said ink pressure chambers, said ink communication holes being exposed on front end surfaces of the stacked second and third substrates, said fourth substrate being fitted on front end faces.

5. An ink-jet head as set forth in claim 2, wherein said common ink chamber is defined by a groove for forming said common ink chamber formed on the upper surface of said third substrate and a film sealing said groove, and at least one ink supply orifice is formed through a bottom portion of said groove for forming the common ink chamber.

6. An ink-jet head as set forth in claim 5, further having nozzle grooves for forming said ink ejection nozzles, wherein said third substrate is a monocrystalline silicon substrate, said nozzle grooves for forming said ink ejection nozzles and said ink supply orifices are formed by trench etching by an ICP discharge, and said groove for forming said common ink chamber is formed by anisotropic wet etching.

7. An ink-jet head as set forth in claim 5, wherein said film is formed along with an ink supply port, and a rib for supporting said film is provided in said common ink chamber for preventing the portion of said film where said ink supply port is formed from deflecting in an out-of-plane direction.

8. An ink-jet head as set forth in claim 2, wherein said electrostatic actuators include a vibration plate formed in a bottom portion of a corresponding ink pressure chamber, elastically displaceable in an out-of-plane direction and serving as a common electrode, and further include an individual electrode formed on the upper surface of said first substrate and opposing to said vibration plate with a given clearance therebetween.

9. An ink-jet printer comprising:

an ink-jet head as defined in claim 1;

a printing paper feeding mechanism for feeding a printing paper across a printing position where printing is performed by said ink-jet head; and drive control means for driving said ink-jet head for performing printing on said printing paper passing across said printing position.

10. An ink-jet printer as set forth in claim 9, wherein said ink-jet head is a line ink-jet head having said ink ejection nozzles arranged over an entire printing width.

11. An ink-jet printer as set forth in claim 9, which further comprises a carriage carrying said ink-jet head for reciprocal motion over the printing width.

12. An ink-jet head as set forth in claim 1, which further comprises an ink supply port for introducing an ink into said common ink chamber, said ink supply orifices being communicated with a first end portion of said common ink chamber, and said ink supply port being communicated with a second end portion of said common ink chamber, and a shape of said common ink chamber in plan view being tapered to widen from said second end portion to said first end portion.

13. An ink-jet head as set forth in claim 12, wherein said first end is an end of said common ink chamber located at the rear end side of said ink-jet head and said second end is an end of said common ink chamber located at the front end side of said ink-jet head.

14. An ink-jet head as set forth in claim 13, wherein a bottom portion and inner peripheral side wall of said common ink chamber is defined by a groove formed by anisotropic wet etching of a monocrystalline silicon substrate for a predetermined depth, and the crystal orientation of said monocrystalline silicon substrate is (100), and said groove is defined by inner peripheral side walls having respective orientations parallel to a (011) orientation face, 45° to a (011) operation face, and 90° to said (011) orientation face.

15. An ink-jet head as set forth in claim 13, wherein a bottom portion and inner peripheral side wall of said common ink chamber is defined by a groove formed by anisotropic wet etching of a monocrystalline silicon substrate for a predetermined depth, and the crystal orientation of said monocrystalline silicon substrate is (100), and said groove is defined by inner peripheral side walls having respective orientations parallel to a (011) orientation face, 19° to a (011) operation face, 45° to said (011) operation face, and 90° to said (011) orientation face.

16. An ink-jet head as set forth in claim 12, which comprises:

a first substrate, a second substrate stacked on an upper surface of said first substrate, and a third substrate stacked on an upper surface of said second substrate;

said third substrate being formed with said common ink chamber and said ink supply orifices;

said second substrate being formed with said ink pressure chambers communicated with said ink ejection nozzles; and said electrostatic actuators being disposed between said first substrate and said second substrate.

17. An ink-jet head as set forth in claim 16, which further comprises a fourth substrate formed with said ink ejection nozzles, ink communication holes communicated with said ink pressure chambers being exposed on front end faces of the stacked second and third substrates, and said fourth substrate being fitted on said front end faces.

18. An ink-jet head as set forth in claim 16, wherein said common ink chamber is defined by a groove for forming said common ink chamber formed on the upper surface of said third substrate and a film sealing said groove, and at least one ink supply orifice is formed through a bottom portion of said groove for forming the common ink chamber.

19. An ink-jet head as set forth in claim 18, further having nozzle grooves for forming said ink injection nozzles wherein said third substrate is a monocrystalline silicon substrate, said nozzle grooves for forming said ink ejection nozzles and said ink supply orifices are formed by trench etching by an ICP discharge, and said groove for forming said common ink chamber is formed by anisotropic wet etching.

20. An ink-jet head as set forth in claim 18, wherein said film is formed along with an ink supply port, and a rib for supporting said film is provided in said common ink chamber for preventing the portion of said film where said ink supply port is formed, from deflecting in an out-of-plane direction.

21. An ink-jet head as set forth in claim 12, wherein said electrostatic actuators include a vibration plate formed in a bottom portion of a corresponding ink pressure chamber, elastically displaceable in an out-of-plane direction and serving as a common electrode, and further includes an individual electrode formed on the upper surface of said first substrate and opposing to said vibration plate with a given clearance therebetween.

22. An ink-jet printer comprising:

an ink-jet head as defined in claim 12;

a printing paper feeding mechanism for feeding a printing paper across a printing position where printing is performed by said ink-jet head; and drive control means for driving said ink-jet head for performing printing on said printing paper passing across said printing position.

23. An ink-jet printer as set forth in claim 22, wherein said ink-jet head is a line ink-jet head arranged said ink ejection nozzles over an entire printing width.

24. An ink-jet printer as set forth in claim 22, which further comprises a carriage carrying said ink-jet head for reciprocal motion over the printing width.

* * * * *